US006095684A

United States Patent [19]

Sribar et al.

[11] Patent Number: 6,095,684

[45] Date of Patent: Aug. 1, 2000

[54] X-RAY TUBE FRAME SUPPORT ASSEMBLY

[75] Inventors: Rok Sribar, Mountainview, Calif.; Brent Lyle Bristol, Phoenix, Ariz.

[73] Assignee: General Electric Company, Schenectady, N.Y.

[21] Appl. No.: 09/208,865

[22] Filed: Dec. 10, 1998

[51] Int. Cl.[7] ..... H05G 1/04

[52] U.S. Cl. ..... 378/193; 378/200; 378/202

[58] Field of Search ..... 375/193, 199, 375/200, 201, 202; 267/141, 141.2, 141.3

[56] References Cited

U.S. PATENT DOCUMENTS

| | | | |
|---|---|---|---|
| 2,454,525 | 11/1948 | Rogers et al. | 378/202 X |
| 3,812,366 | 5/1974 | Gralenski | 378/202 X |
| 4,433,432 | 2/1984 | Nii et al. | 378/193 |
| 5,547,173 | 8/1996 | Tsutsumida et al. | 267/140.15 |
| 5,890,704 | 4/1999 | Tsutsumida | 267/140.12 |

*Primary Examiner*—David P. Porta

[57] ABSTRACT

An X-ray tube frame support assembly includes an annular support structure defining an interior chamber and having an interior surface surrounding and spaced radially outwardly from an X-ray tube frame disposed within the interior chamber, a quantity of cooling fluid contained in the interior chamber about the X-ray tube frame, and contact elements spaced from one another and mounted to the support structure so as to protrude radially inwardly from the interior surface into the interior chamber of the support structure and through the quantity of cooling fluid contained therein toward the X-ray tube frame such that the contact elements contact and hold the X-ray tube frame therebetween. Each contact element includes a body defining a hollow interior cavity and having apertures allowing passage of the cooling fluid into and from the interior cavity of the body for providing a passive damping of any vibrational movement of the X-ray tube frame.

20 Claims, 1 Drawing Sheet

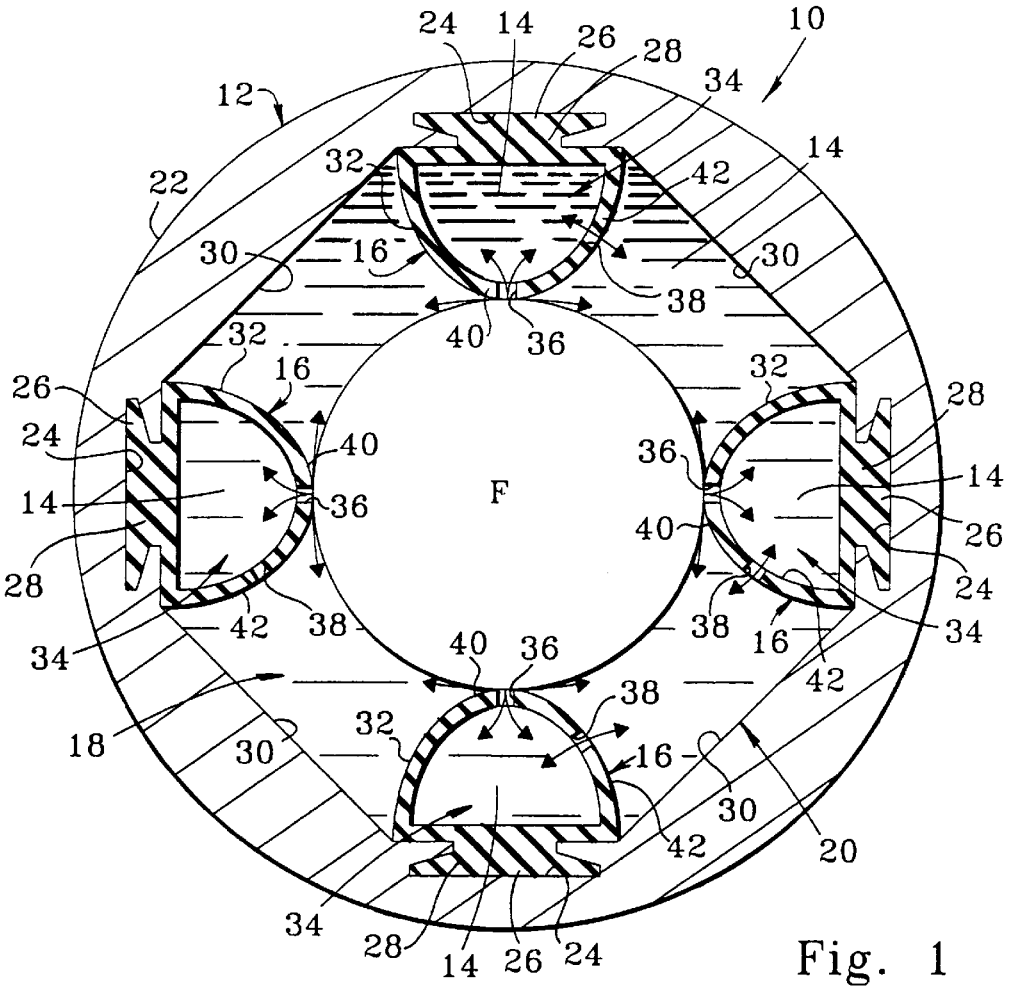
Fig. 1
Fig. 2
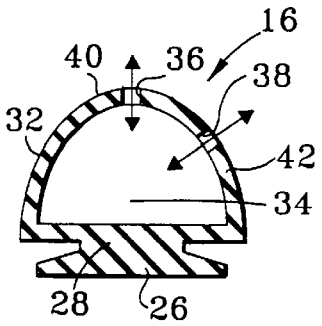

X-RAY TUBE FRAME SUPPORT ASSEMBLY

BACKGROUND OF THE INVENTION

The present invention generally relates to X-ray tubes and, more particularly, is concerned with an X-ray tube frame support assembly.

X-ray equipment used in the medical field typically includes a rotating anode X-ray tube. Such X-ray tube is a vacuum tube which includes a rotor having a rotatable shaft, a stator which circumferentially surrounds, or is surrounded by, the rotatable shaft and a tube frame support structure, also called a snubber, which is used to support the frame of the tube within a casing opposite a tube basket. The X-ray tube rotor creates vibrations and audio noise in operation. The design of the tube frame support structure affects the level of vibration and/or audio noise.

Existing X-ray tubes are generally designed with rubber elements, which are solid and which serve as contacts between the tube frame and snubber, and cooling oil which surrounds the tube frame. The solid rubber elements and cooling oil dampen the X-ray tube system. Experiments show that damping between the tube casing and frame affects rotor performance and also the level of vibration and/or audio noise.

A need remains for an assembly which provides an optimum degree of damping for enhancing the performance of and for reducing the level of vibration and/or audio noise of the X-ray tube system and without introducing any new problems to the system.

BRIEF SUMMARY OF THE INVENTION

The present invention provides an X-ray tube frame support assembly designed to satisfy the aforementioned need. The X-ray tube frame support assembly of the present invention includes a support structure which has a plurality of hollow contact elements surrounding and contacting an X-ray tube frame. The hollow contact elements, in comparison to conventional solid contact elements, provide additional inexpensive passive damping to the X-ray tube frame. The additional passive damping of the hollow contact elements enhances the performance of and reduces the level of vibration and/or audio noise of the X-ray tube system.

In an exemplary embodiment of the present invention, a support assembly for an X-ray tube frame comprises a support structure defining an interior chamber and having an interior surface surrounding and spaced radially outwardly from an X-ray tube frame disposed within the interior chamber, a quantity of cooling fluid contained in the interior chamber of the support structure about the X-ray tube frame, and a plurality of contact elements spaced from one another about and mounted to the support structure so as to protrude radially inwardly from the interior surface across the interior chamber of the support structure and through the quantity of fluid therein toward the X-ray tube frame such that the contact elements contact and hold the X-ray tube frame therebetween. At least one or all of the contact elements includes a body defining a hollow interior cavity and having at least one aperture through the body to allow passage of the cooling fluid into and from the interior cavity of the body and correspondingly from and into the interior chamber of the support structure for providing a passive damping of any vibrational movement of the X-ray tube frame.

In an example, the support structure includes a plurality of first attachment elements defined therein in spaced relationship from one another about the interior surface of the support structure. Each of the contact elements has a second attachment element defined thereon for securement with a respective one of the first attachment elements of the support structure to mount the contact elements to the support structure. Each of the second attachment elements is complementary in configuration to the respective one of the first attachment elements. Also, each of the first and second attachment elements has a complementary tongue and groove configuration.

In a further example, the body of each of the contact elements has a substantially semi-circular cross-sectional configuration such that one curved portion of said body contacts the X-ray tube frame. The body of each of the contact elements also has a pair of apertures therethrough. One of the apertures is defined through the one curved portion of the body and the other of the apertures is defined through another curved portion of the body spaced from the one curved portion and from the X-ray tube frame.

BRIEF DESCRIPTION OF THE DRAWINGS

FIG. 1 is a cross-sectional view of an X-ray tube frame support assembly of the present invention.

FIG. 2 is a cross-sectional view of one of a plurality of hollow contact elements of the X-ray tube frame support assembly of the present invention.

DETAILED DESCRIPTION OF THE INVENTION

Referring to the drawings and particularly to FIG. 1, there is illustrated an X-ray tube frame support assembly, generally designated 10, incorporating features of the present invention. Similar to its prior art arrangement, the support assembly 10 of the present invention basically includes an annular support structure 12, a quantity of cooling fluid 14 contained therein, and a plurality of contact elements 16. While in the prior art arrangement the contact elements were of solid construction, in the support assembly 10 of the present invention at least one or all of the contact elements 16 are hollow and perforated which, as explained below, provides an enhanced passive damping capability not attainable with the solid contact elements of the prior art.

The support structure 12 defines an interior chamber 18 and has an interior surface 20 that surrounds and is spaced radially outwardly from the supported X-ray tube frame F which is disposed within the interior chamber 18. The quantity of cooling fluid 14, such as a conventional cooling oil, is contained in the interior chamber 18 of the support structure 12 about the X-ray tube frame F. The hollow contact elements 16, as in the case of the prior art solid contact elements, are spaced from one another and mounted to the support structure 12 so as to protrude radially inwardly from the interior surface 20 thereof across the interior chamber 18 thereof through the quantity of cooling fluid 14 to the X-ray tube frame F such that the contact elements 16 contact and hold the X-ray tube frame F therebetween.

The support structure 12 also has an exterior surface 22 of a substantially circular configuration in transverse cross-section. The interior surface 20 of the support structure 12 has a substantially polygonal, and specifically octagonal, configuration in transverse cross-section. The support structure 12 further includes a plurality of first attachment elements 24 defined therein in spaced relationship from one another about the interior surface 20 of the support structure 12. The contact elements 16 have respective bases 26 defining second attachment elements 28 for securement with respective ones of the first attachment elements 24 of the support structure 12 to mount the contact elements 16 to the support structure 12 at the interior surface 20 thereof. In the example illustrated in FIG. 1, the first and second attachment elements 24, 28 have complementary tongue and groove configurations, although other configurations are equally possible.

The interior surface 20 of the support structure 12 also includes a plurality of flat surface portions 30 each extending between an adjacent pair of the first attachment elements 24. The flat surface portions 30 include a first pair thereof disposed opposite and substantially parallel to one another and a second pair thereof disposed opposite and substantially parallel to one another and substantially perpendicular to the flat surface portions 30 of the first pair thereof. Each of the flat surface portions has substantially the same length in a transverse cross-section.

Referring to FIGS. 1 and 2, the contact elements 16 are four in number, though there may be any other suitable number thereof. Each contact element 16 is spaced at about an equal distance from each of a pair of adjacent contact elements 16. The contact elements 16 are disposed on the interior surface 20 of the support structure 12 between the adjacent ones of flat surface portions 30 of the interior surface 20 of the support structure 12.

In addition to the base 26, each contact element 16 has a body 32 attached on the base 26 and protruding radially inwardly toward the X-ray tube frame F. The body 32 is hollow and perforated. Specifically, the hollow body 32 is of substantially semi-circular cross-sectional configuration and encloses and defines a hollow cavity 34 therein. The hollow body 32 also has at least one or a pair of apertures 36, 38 formed therethrough. The apertures 36, 38 allow passage of the cooling fluid 14 into and from the interior cavity 34 and thus corresponding from and into the interior chamber 18 of the support structure 12. The presence of the interior cavity 34 and the resultant channeling movement of the cooling fluid 14 into and from the contact elements 16 provide for an enhanced passive damping of any vibrational movement of the X-ray tube frame F which a solid type of contact element of the prior art does not provide to the X-ray tube frame F. The contact elements 16 are comprised of any substantially flexible material, such as rubber or the like.

A first curved portion 40 of the hollow body 32 contacts the X-ray tube frame F and has defined through it the one aperture 36. The other aperture 38 is defined through a second curved portion 42 of the hollow body 32 spaced from the first curved portion 40 thereof and from the X-ray tube frame F. The contact elements 16 are substantially identical in size although they may also have different sizes. The size of the interior cavities 34 and the number and positions of apertures 36, 38 through the bodies 32 thereof all affect the amplitude of the damping force and may be chosen by the artisan to meet specific design requirements.

It is thought that the present invention and its advantages will be understood from the foregoing description and it will be apparent that various changes may be made thereto without departing from the spirit and scope of the invention or sacrificing all of its material advantages, the form hereinbefore described being merely an exemplary embodiment thereof.

What is claimed is:

1. A support assembly for an X-ray tube frame, comprising:

(a) a support structure defining an interior chamber and having an interior surface surrounding and spaced radially outwardly from an X-ray tube frame disposed within said interior chamber;

(b) a quantity of cooling fluid contained in said interior chamber of said support structure about the X-ray tube frame; and (c) a plurality of contact elements spaced from one another and mounted to said support structure so as to protrude inwardly from said interior surface across said interior chamber of said support structure and through said quantity of fluid therein toward the X-ray tube frame such that said contact elements contact and hold the X-ray tube frame therebetween, at least one of said contact elements including a body defining a hollow interior cavity and having at least one aperture through said body to allow passage of said cooling fluid into and from said interior cavity of said body for providing a passive damping of vibrational movement of the X-ray tube frame.

2. The assembly of claim 1 wherein each of said contact elements is spaced at about the same distance from each of a pair of adjacent contact elements.

3. The assembly of claim 1 wherein said interior surface of said support structure has a polygonal cross-sectional configuration.

4. The assembly of claim 1 wherein:

said support structure includes a plurality of first attachment elements defined therein in spaced relationship from one another about said interior surface thereof; and each of said contact elements has a second attachment element defined thereon for securement with a respective one of said first attachment elements of said support structure to mount said contact elements to said support structure.

5. The assembly of claim 4 wherein each of said second attachment elements are complementary in configuration to the respective one of said first attachment elements.

6. The assembly of claim 5 wherein each of said first and second attachment elements has a complementary tongue and groove configuration.

7. The assembly of claim 4 wherein said interior surface of said support structure includes a plurality of flat surface portions each extending between an adjacent pair of said first attachment elements.

8. The assembly of claim 7 wherein said flat surface portions include a first pair thereof disposed opposite and substantially parallel to one another and a second pair thereof disposed opposite and substantially parallel to one another and substantially perpendicular to said flat surface portions of said first pair thereof.

9. The assembly of claim 1 wherein said body of said one contact element has a substantially semi-circular cross-sectional configuration such that one curved portion of said body contacts the X-ray tube frame.

10. The assembly of claim 9 wherein said body of said one contact element has a pair of apertures, one of said apertures being defined through said one curved portion of said body and the other of said apertures being defined through another curved portion of said body spaced from said one curved portion and from the X-ray tube frame.

11. A support assembly for an X-ray tube frame, comprising:

(a) a support structure defining an interior chamber and having an interior surface surrounding and spaced radially outwardly from an X-ray tube frame disposed within said interior chamber;

(b) a quantity of cooling fluid contained in said interior chamber of said support structure about the X-ray tube frame; and (c) a plurality of resiliently flexible contact elements spaced from one another and mounted to said support structure so as to protrude radially inwardly from said interior surface across said interior chamber of said support structure and through said quantity of fluid therein toward the X-ray tube frame such that said contact elements contact and hold the X-ray tube frame therebetween, each of said contact elements including a body defining a hollow interior cavity and having at least one aperture through said body to allow passage of said cooling fluid into and from said interior cavity of said body and correspondingly from and into said interior chamber of said support structure for providing a passive damping of vibrational movement of the X-ray tube frame.

12. The assembly of claim 11 wherein each of said contact elements is spaced at substantially the same distance from each of a pair of adjacent contact elements.

13. The assembly of claim 11 wherein said interior surface of said support structure has a polygonal cross-sectional configuration.

14. The assembly of claim 11 wherein:

said support structure includes a plurality of first attachment elements defined therein in spaced relationship from one another about said interior surface thereof; and each of said bodies of said contact elements has a base defining a second attachment element for securement with a respective one of said first attachment elements of said support structure to mount said contact elements to said support structure.

15. The assembly of claim 14 wherein each of said second attachment elements are complementary in configuration to the respective one of said first attachment elements.

16. The assembly of claim 15 wherein each of said first and second attachment elements has a complementary tongue and groove configuration.

17. The assembly of claim 14 wherein said interior surface of said support structure includes a plurality of flat surface portions each extending between an adjacent pair of said first attachment elements.

18. The assembly of claim 17 wherein said flat surface portions include a first pair thereof disposed opposite and substantially parallel to one another and a second pair thereof disposed opposite and substantially parallel to one another and substantially perpendicular to said flat surface portions of said first pair thereof.

19. The assembly of claim 11 wherein said bodies of said contact elements have substantially semi-circular cross-sectional configurations such that one curved portion of each of said bodies contacts the X-ray tube frame.

20. The assembly of claim 19 wherein each of said bodies of said contact elements has a pair of apertures, one of said apertures being defined through said one curved portion of said body and the other of said apertures being defined through another curved portion of said body spaced from said one curved portion and from the X-ray tube frame.

* * * * *